US005707177A

United States Patent [19]

Lehrer et al.

[11] Patent Number: 5,707,177

[45] Date of Patent: Jan. 13, 1998

[54] BUOYANCY CONTROL DEVICE FOR DIVERS

[75] Inventors: Alon Lehrer, Apt. 19, 9 Haprachim St., Romema, Haifa 34733; Daniel Messinger, Migdal Haemek, both of Israel

[73] Assignee: Alon Lehrer, Haifa, Israel

[21] Appl. No.: 498,215

[22] Filed: Jul. 5, 1995

[30] Foreign Application Priority Data

Jul. 18, 1994 [IL] Israel ..... 110358

[51] Int. Cl.[6] ..... B63C 11/02

[52] U.S. Cl. ..... 405/186; 405/193

[58] Field of Search ..... 405/186, 185, 405/193; 116/137 R

[56] References Cited

U.S. PATENT DOCUMENTS

| | | | |
|---|---|---|---|
| 1,390,474 | 9/1921 | Tibbits . | |
| 1,917,613 | 7/1933 | Szumkowski . | |
| 2,781,041 | 2/1957 | Weinberg | 128/60 |
| 4,068,657 | 1/1978 | Kobzan | 128/142 R |
| 4,114,389 | 9/1978 | Bohmrich et al. | 405/186 |
| 4,229,832 | 10/1980 | Dickson, Sr. | 2/2.1 R |
| 4,324,507 | 4/1982 | Harrah | 405/186 |
| 4,437,790 | 3/1984 | Trop | 405/186 |
| 4,579,147 | 4/1986 | Davies et al. | 137/854 |
| 4,601,609 | 7/1986 | Hyde | 405/186 |
| 4,913,589 | 4/1990 | Faulconer et al. | 405/186 |
| 4,986,700 | 1/1991 | Takeda | 405/186 |
| 5,249,890 | 10/1993 | Bergstrom | 405/186 |
| 5,363,790 | 11/1994 | Matsuoka | 405/186 X |

FOREIGN PATENT DOCUMENTS 112426 7/1943 Netherlands .

*Primary Examiner*—Frank Tsay

*Attorney, Agent, or Firm*—Lahive & Cockfield, LLP; Anthony A. Laurentano

[57] ABSTRACT

A buoyancy control device for divers includes a plurality of inflatable members each adapted to be inflated to a predetermined maximum volume, or to be deflated, and a fluid distributor for selecting the inflatable members to be inflated and to be deflated, thereby controlling the buoyancy of the device. The fluid distributor includes a housing having an inlet port connectible to a source of pressurized fluid, a venting port leading to the atmosphere, and a plurality of outlet ports connected to the inflatable members. A flexible membrane overlies a grooved surface in the housing, and a valve member is movable over the membrane to press it into the groove such as to effect the communication between the inlet and venting ports with respect to selected outlet ports.

13 Claims, 5 Drawing Sheets

BUOYANCY CONTROL DEVICE FOR DIVERS

FIELD AND BACKGROUND OF THE INVENTION

The present invention relates to a buoyancy control device for divers to enable a diver to operate at any desired depth. The invention is particularly useful for scuba divers, and is therefore described below with respect to this application.

One form of buoyancy control device commonly used by scuba divers includes an inflatable member defining an expansible chamber which can be expanded or contracted as desired in order to control the buoyancy of the diver. However, a serious drawback in such a buoyancy control device is that the volume of the expansible chamber changes with depth because of the external water pressure acting on the chamber, and therefore the volume of the expansible chamber must be continuously adjusted. Moreover, when descending to a relatively large depth, the water pressure at the large depth contracts the chamber, which may thereby increase the intended depth. This could cause "nitrogen narcosis", also known as "rapture of the deep", resulting from the formation of gaseous nitrogen at high pressure in the blood of the diver, and is particularly dangerous for inexperienced scuba divers.

In order to minimize these drawbacks, it has been proposed to include hydrostatically controlled valves which automatically control the volume of the expansible chamber in response to the external pressure. An example of this technique is described in U.S. Pat. No. 4,601,609. However, such hydrostatic controls, besides being costly, consume large quantities of the limited supply of air, and thereby shorten the period of time the diver can remain under water before requiring the air supply to be refilled.

Another form of buoyancy control device, as described for example in U.S. Pat. Nos. 4,068,657 and 4,144,389, includes a constant volume, rigid tank into which water is admitted or expelled to adjust the buoyancy. Such devices, however, are extremely inconvenient and complex to operate, and therefore can affect the diver's safety as well as the pleasure of diving.

OBJECTS AND BRIEF SUMMARY OF THE INVENTION

An object of the present invention is to provide a buoyancy control device having advantages in the above respects. Another object of the invention is to provide a fluid distributor particularly useful in the novel buoyancy control device.

According to the present invention, there is provided a buoyancy control device for divers, comprising: a plurality of inflatable members each adapted to be inflated to a predetermined maximum volume, or to be deflated; attaching mean for attaching the inflatable members to the torso of a diver; a source of compressed air for inflating the inflatable members to their respective predetermined maximum volumes; an air line connecting the source of compressed air to the air line connecting the source of compressed air to the plurality of inflatable members; and a selector in the air line for selecting the inflatable members to be inflated and to be deflated, thereby controlling the buoyancy of the device.

According to further features in the described preferred embodiment, the attaching means is in the form of a jacket incorporating the inflatable members. In the described embodiments, the jacket is a sleeveless vest easily worn by the diver and incorporating the inflatable members in both its front and rear sides.

Each of the inflatable members may include an inflatable tube enclosed by a non-stretchable cover to thereby limit the maximum volume of the inflatable tube. Another construction which may be used is one in which each of the inflatable members includes an inflatable tube of a material which is stretchable up to a maximum limit to thereby limit the maximum volume of the inflatable tube.

As will be described more particularly below, a buoyancy control device constructed in accordance with the foregoing features enables a diver wearing the device to inflate a preselected number of the inflatable members in order to achieve a "neutral buoyancy" at a desired depth. Since each of the members is either in a maximum inflated condition or a non-inflated condition, their volumes do not change with changes in depth, and therefore their volumes will remain substantially the same during ascent as well as descent. Accordingly, there is less chance the diver will descend below the intended depth because of the contraction of the volume of the inflatable members by the pressure of the water at large depths. Nor will the diver be subjected to acceleration of a descent or ascent because of a change in the volume of the inflatable members. Moreover, such a buoyancy control device frees the diver from attempting to continuously control the buoyancy of the device during changes in depth, and also avoids the wastage of air involved in such continuous control of buoyancy during changes in depth. All the foregoing advantages substantially increase the diver's safety as well as the pleasure in diving.

According to another aspect of the present invention, there is provided a fluid distributor particularly useful in the novel buoyancy control device. Such fluid distributor comprises a housing having an inlet port connectible to a source of pressurized fluid, a venting port leading to the atmosphere, and a plurality of outlet ports. The housing includes a surface formed with a groove communicating with all the ports. A flexible membrane overlies the latter surface and has an inner face facing the groove, and an outer face facing away from the groove. A valve member is movable over the outer face of the membrane to press the membrane into the groove such as to effect communication between the inlet and venting ports with respect to selected outlet ports.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
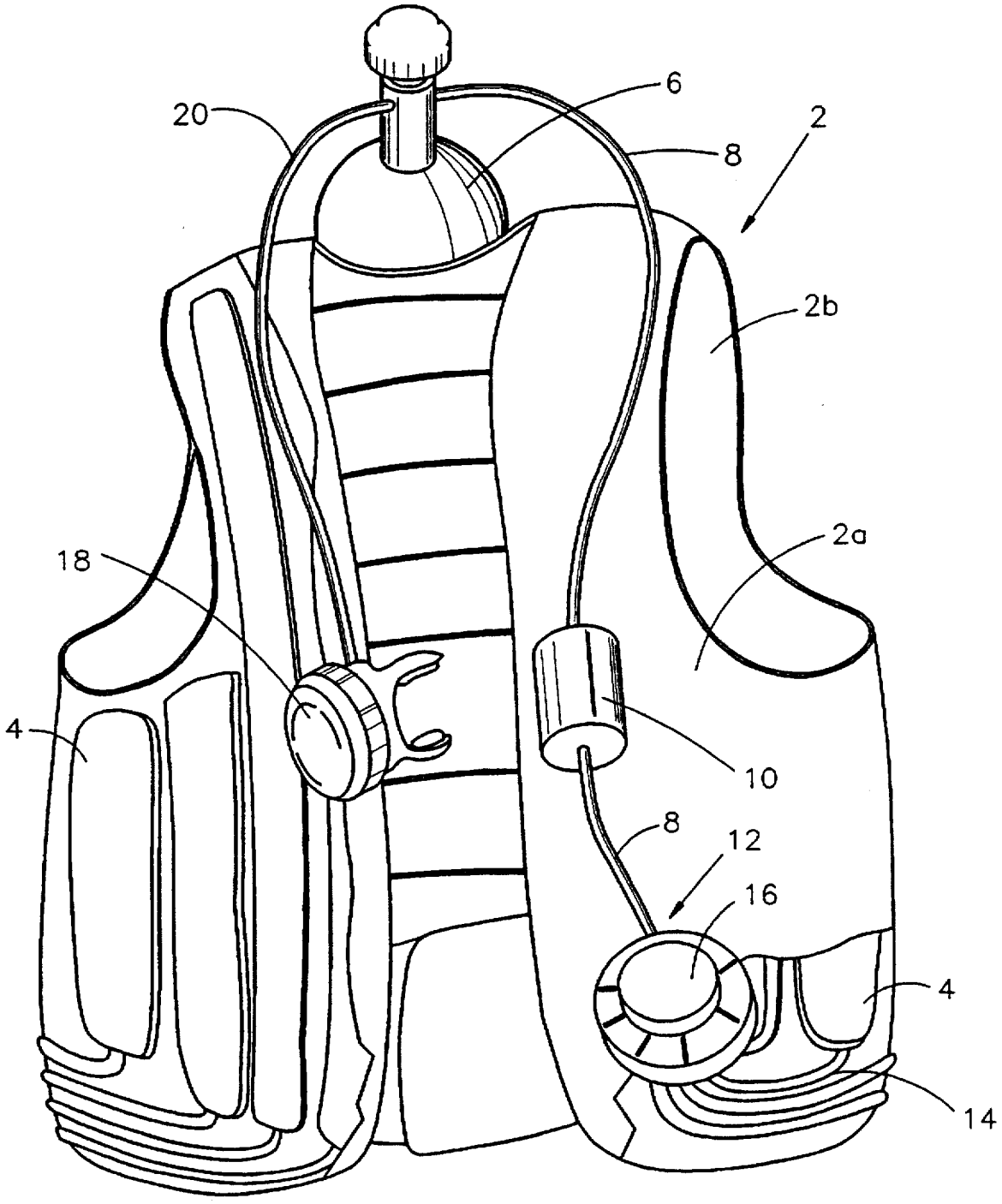
FIG. 1 illustrates one form of buoyancy control device constructed in accordance with the present invention, the figure being partly broken away to show internal structure.

The buoyancy control device illustrated in FIG. 1 is in the form of a jacket, more particularly a sleeveless vest generally designated 2, to be worn by the diver. The illustrated vest 2 incorporates a plurality of inflatable members 4 in both the front side 2*a* and the rear side 2*b* of the vest. In FIG. 1, the inflatable members 4 extend in the vertical direction in the front side 2*a*, and in the horizontal direction in the rear side 2*b*, but this is shown merely for purposes of example.

The buoyancy control device illustrated in FIG. 1 further includes a tank 6 of compressed air. Tank 6 is adapted to be worn by the diver by means of a harness or in any other suitable manner. The compressed air tank 6 is connected by an air line 8 and a pressure reducer 10 to a fluid distributor 12 which selects the inflatable member or members to be inflated by the air within tank 6. Pressure reducer 10 reduces the high pressure of the compressed gas within tank 6 sufficient to inflate the inflatable members 4 and to maintain that pressure. Each of the inflatable members 4 includes a connecting tube 14 connected to fluid distributor 12. A selector knob 16 of the fluid distributor may be manually rotated to a selected position to connect selected ones of the inflatable member tubes 14 either to the air line 8 to inflate the respective inflatable member, or to an external vent in order to deflate the respective inflatable member.

The illustrated buoyancy control device 2 further includes a mouthpiece 18 connected by air line 20 to the compressed air tank 6 to provide the diver with air for breathing purposes.

Figure 3:
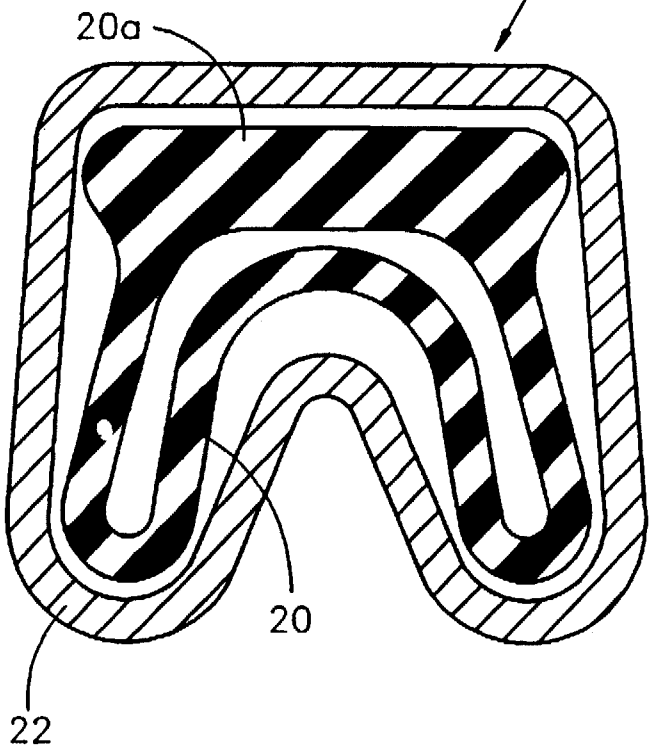
FIG. 3 illustrates the inflatable member of FIG. 2 in its deflated condition.
Figure 2:
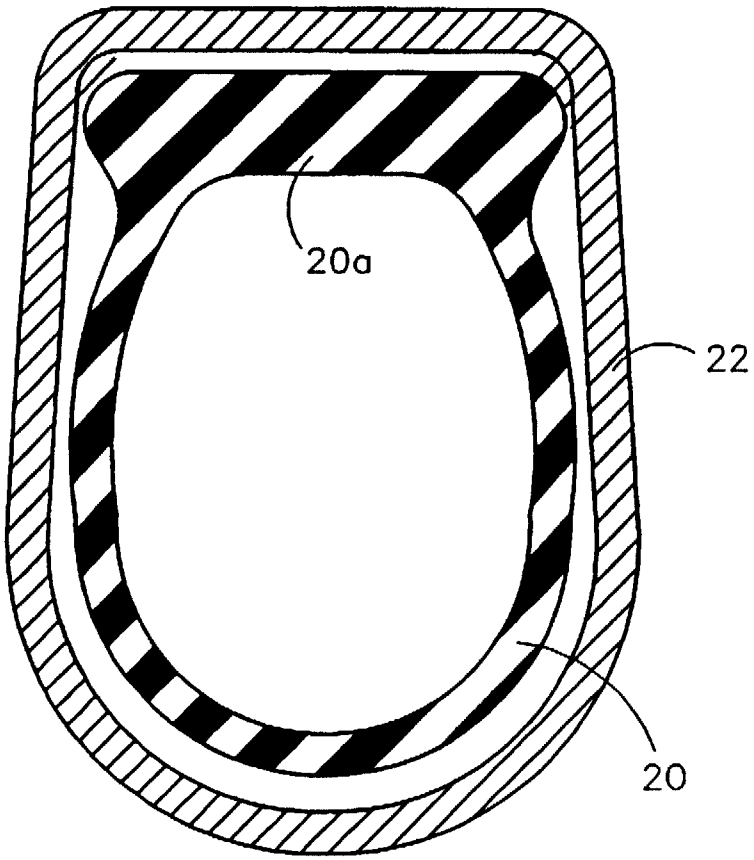
FIG. 2 is a sectional view illustrating one of the inflatable members in the buoyancy control device of FIG. 1 in the inflated condition of the member.

The construction of the inflatable members 4 is more particularly illustrated in FIGS. 2 and 3. Each inflatable member 4 includes an inflatable tube 20 of rubber or other elastomeric material, and an outer jacket 22 of a non-stretchable material, such as a flexible fabric. The base 20*a* of each inflatable tube 20 is somewhat flattened and thickened, as compared to the remainder 20*b* of the inflatable tube. Base 20*a* is at the inner face of the vest so as to be located next to the diver's body when wearing the jacket.

FIG. 2 illustrates the inflated condition of an inflatable member 4, wherein it will be seen that its tube 20 is inflated to a maximum volume as determined by the outer non-stretchable jacket 22. FIG. 3 illustrates the non-inflated condition of a member 4, wherein it will be seen that its tube 20 occupies a minimum volume because of the external pressure exerted on it by the water.

Thus, as shown in FIGS. 2 and 3, each inflatable member 4 may be either in its fully-inflated condition occupying a maximum volume as shown in FIG. 2, or in its non-inflated condition occupying a minimum volume as shown in FIG. 3. The selection of either of the above conditions of the inflatable members is made manually by the diver by controlling the fluid distributor 12 as will be described below.

Instead of using a non-stretchable outer covering 22 for limiting the maximum volume of the buoyancy member when fully inflated, this may also be done by including, in the inflatable tube 20, a material which is either stretchable up to a maximum limit or which otherwise limits the stretchability of the inflatable tube 20 (e.g., by the inclusion of non-stretchable threads) so that it assumes a maximum volume when inflated. In such case, outer covering 22 could be omitted.

Figure 4:
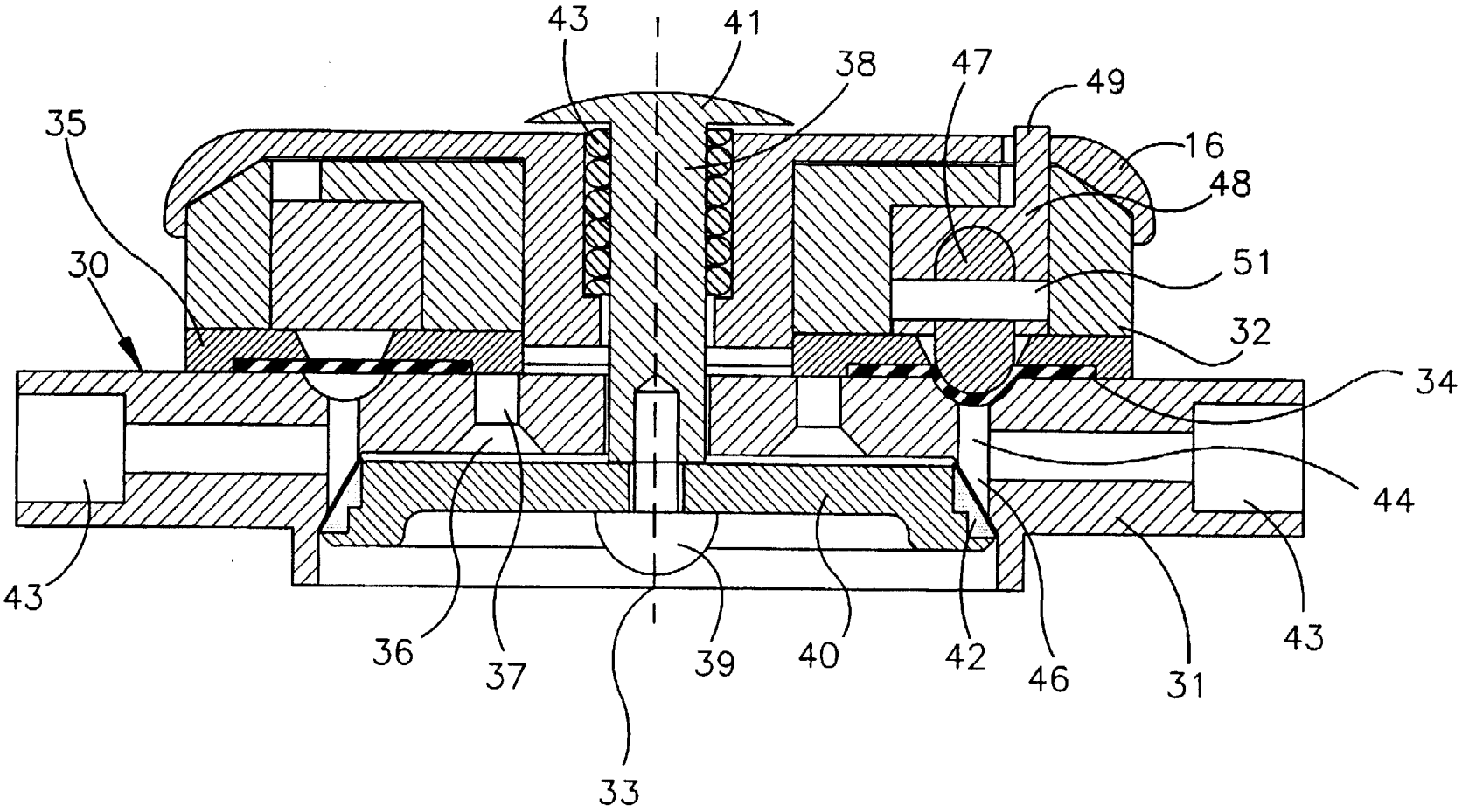
FIG. 4 is a sectional view illustrating the fluid distributor in the buoyancy control device of FIG. 1.
Figure 5:
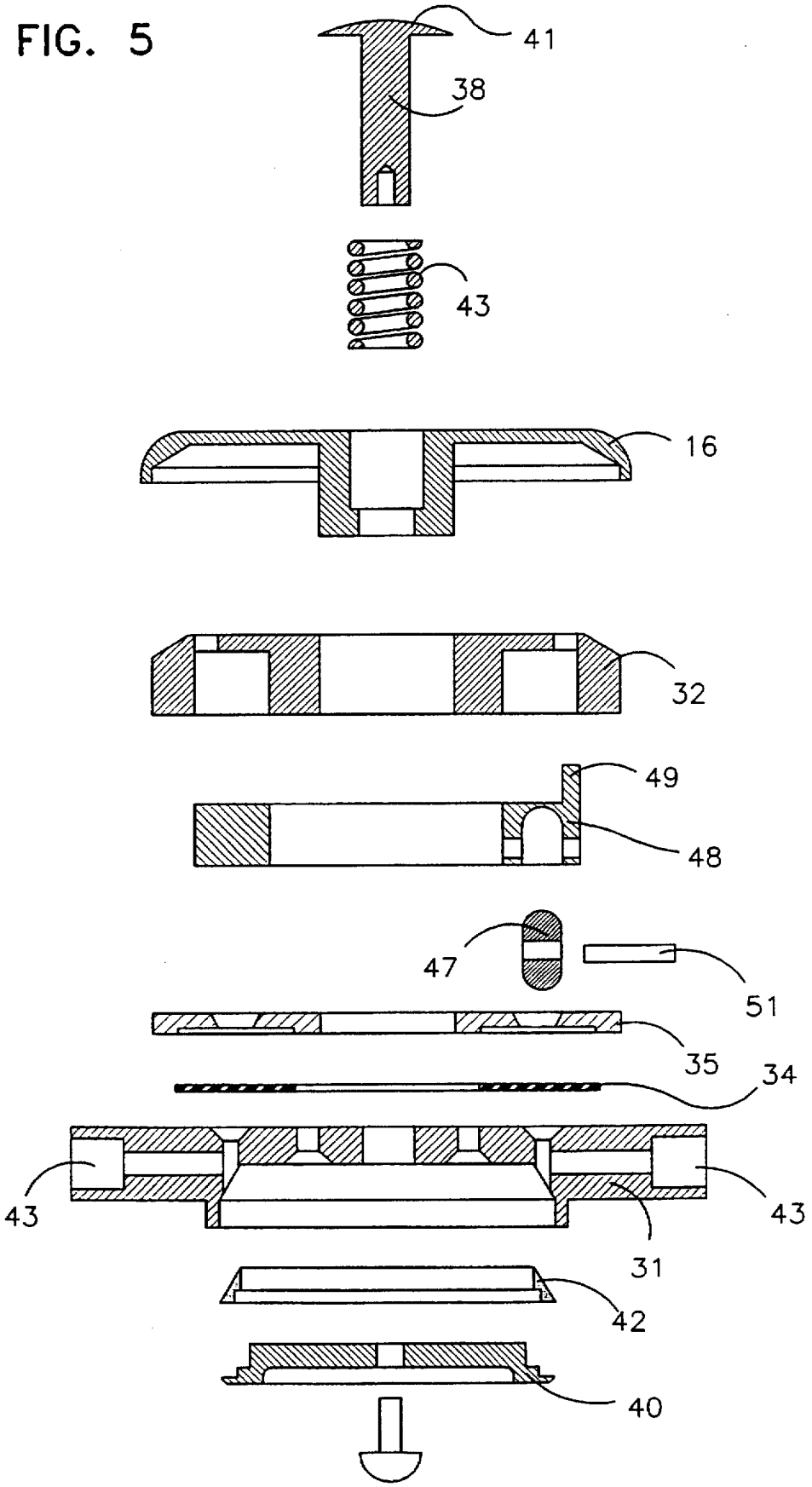
FIG. 5 is an exploded view illustrating the main elements of the fluid distributor of FIG. 4.
Figure 6:
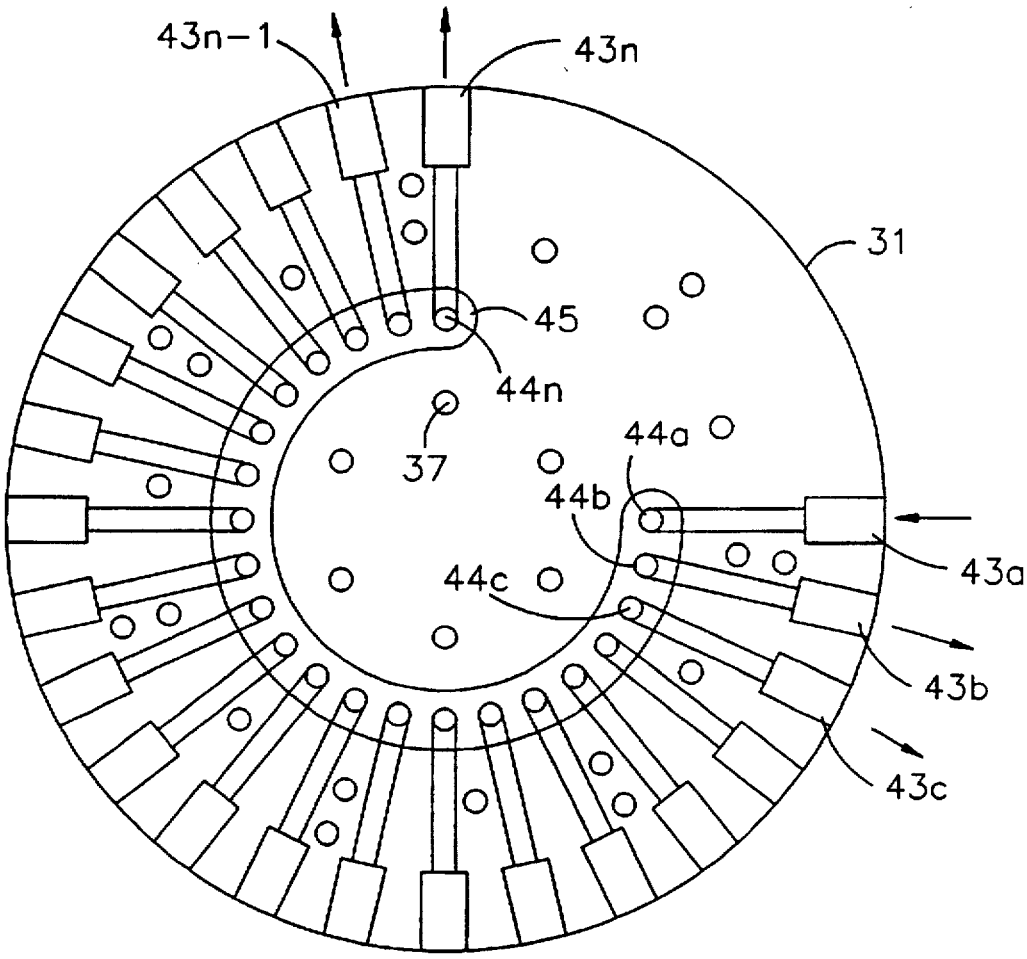
FIG. 6 is a plan view illustrating the main housing section in the fluid distributor of FIGS. 4 and 5.

The fluid distributor 12 is more particularly illustrated in FIGS. 4–6. It includes a housing 30 having a fixed housing section 31 and a rotatable housing section 32 rotatable by knob 16 about axis 33 of the fixed housing section. A membrane 34 of elastomeric material is clamped to the fixed housing section 31 by a clamping plate 35 receiving a plurality of threaded fasteners 36 passing through holes 37 formed in the fixed housing section 31.

Rotatable knob 16 is formed with a cavity receiving the rotatable housing section 32. The latter section and its rotatable knob 16 are assembled to the fixed housing section 31 by a central stem 38 passing through central openings formed in rotatable knob 16, the rotatable housing section 32, and the fixed housing section 31. The inner end of stem 38 is fixed by a fastener 39 to a valve member 40. The outer end of stem 38 terminates in an enlarged head 41.

Valve member 40 carries an annular sealing ring 42 which is urged against the undersurface of the fixed housing section 31 by a coil spring 43 interposed between outer head 41 of stem 38, and the aperture surface of rotatable knob 16 receiving the stem. As will be described more particularly below, in this normal condition of valve member 40, its sealing ring 42 closes a number of ports in the underside of the fixed housing section 31, but manual depression of head 41 moves valve member 40 away from the underside of the fixed housing section 31 to open these ports simultaneously.

The fixed housing section 31 is formed with a circular array of radially-extending ports 43 (FIG. 5), more particularly shown at 43*a*–43*n* in FIG. 6. Port 43*a*, which is the first port at one end of the circular array, is an inlet port connected to the pressurized air tank 6. Port 43*n*, which is the last port at the opposite end of the array, is connected to the atmosphere. All the other ports 43*b*–43*n*-1 are connected to the various inflatable members 4 of the buoyancy jacket 2.

As shown in FIGS. 4 and 5, the fixed housing section 31 is further formed with a plurality of axially-extending bores 44, one for each of the ports 43 and passing axially through the respective port to the two opposite faces of the lower housing section 31. The upper face of housing section 31 is formed with a circular groove 45 connecting together the respective ends of all the bores 44. The lower face 46 of housing section 31, through which the lower ends of all the bores 44 pass, is of conical configuration.

Membrane 34 is applied over groove 45 in the upper face of housing section 31 to overlie all the bores 44. A roller valve 47 has an outer surface conforming to that of groove 45 and is aligned with the groove. Thus, as roller 47 is rotated, it moves along the groove and presses the membrane against the bottom wall of the groove to thereby interrupt the communication via the groove at that point.

Roller valve 47 is rolled along groove 45 by a valve carrier 48 which is received within a cavity formed in the rotatable housing section 32. Valve carrier 48 includes a tongue 49 passing through aligned openings in the rotatable housing section 32 and in its rotatable knob 16 so that the valve carrier is rotated upon the rotation of the knob. Carrier 48 further includes a pin 50 mounting the valve roller 47 for rotation when the carrier is rotated with the knob. Roller 47 thus serves as a valve member movable by rotatable knob 16 over the outer face of membrane 34 to press the membrane into the groove 45 such as to effect communication between the inlet port 43*a* and the venting port 43*n* with respect to selected output ports 43*b*–43*n*-1.

Valve member 40, on the other hand, serves as a main release valve which is normally closed, but which may be manually opened by depressing head 41 of stem 38 to vent all the ports 43 to the atmosphere. For this purpose, the main release valve 40 is normally seated within the conical cavity 46 and is of a complementary conical configuration. Main release valve 40 thus normally closes the outer ends of all the bores 44, thereby interrupting the communication between all the ports 43 and the atmosphere. However, depressing head 41 moves the main valve member to its open position to simultaneously open all the ports 43 to the atmosphere.

The illustrated buoyancy control vest is used as follows:

The diver rotates knob 16 of fluid distributor 12 to select the inflatable members 4 to be inflated and those to be deflated, to thereby establish neutral buoyancy at the selected depth. The selection of the inflatable members 4 to be inflated and deflated is determined by the location of valve roller 47 in the circular groove 45. Thus, if knob 16 is rotated to position roller valve 47 between bores **44*a* and 44*b*, none of the inflatable members 4 will be connected to the pressurized inlet port 43*a*, but rather all will be connected to the venting port 43*n*; accordingly, none of the inflatable members 4 will be inflated. However, if knob 16 is rotated to bring roller valve 47 between bores 44*b* and 44*c*, one of the inflatable members 4 will be inflated; if the valve roller is moved to a position between bores 44*c* and 44*d***, two inflatable members will be inflated; and so on, with respect to the other positions of the valve roller.

The diver may thus select the number of inflatable members 4 to be inflated by merely rotating knob 16 to the appropriate position. All the inflatable members connected to the ports 43 which are thereby connected to the pressurized air in port **43*a* will be inflated, whereas all the other inflatable members will be connected to the venting port 43*n* and will therefore be deflated. Whenever desired, all the inflatable members 4 can be deflated simultaneously by merely depressing head 41 which will, as described above, move the main valve member 40 away from the underside of housing section 31 to open the lower ends of all the bores 44** simultaneously, thereby venting all the ports simultaneously to the atmosphere.

For example, when the diver wishes to descend to a predetermined depth, selector knob 16 would be rotated to inflate the appropriate number of inflatable members 4 to provide the buoyancy required at that depth. As the diver descends, the buoyancy of the vest is not significantly changed with the change in depth since the inflated members remain inflated at their maximum volumes, and the deflated members remain deflated at their minimum volumes; thus, there is no significant volume change during descent by the diver. The same applies during ascent by the diver.

Accordingly, there is a minimum danger that the descent will be below the intended depth, or that the descent or ascent will be accelerated by volume changes, thereby freeing the diver from the necessity of continuously adjusting the buoyancy of the inflatable members. This not only reduces the danger to the diver but also conserves the air supply previously consumed in making buoyancy changes, and frees the diver from the need to continuously make these adjustments.

While the invention has been described with respect to a preferred embodiment, it will be appreciated that this is set forth merely for purposes of example, and that many other variations, modifications and applications of the invention may be made.

We claim:

1. A buoyancy control device for divers, comprising:

a plurality of inflatable members, such that when the device is underwater, each member is inflated to a predetermined maximum volume, or maintained at a predetermined minimal volume, said volumes being substantially independent of external water pressure;

attaching means for attaching the inflatable members to the torso of a diver;

a source of compressed air for inflating said inflatable members to their respective predetermined maximum volumes;

an air line connecting said source of compressed air to said plurality of inflatable members; and a fluid distributor in said air line for selecting the inflatable members to be inflated and to be deflated, thereby controlling the buoyancy of the device.

2. The buoyancy control device according to claim 1, wherein said attaching means is in the form of a jacket incorporating said inflatable members.

3. The buoyancy control device according to claim 1, wherein each of said inflatable members includes an inflatable tube enclosed by a non-stretchable cover to thereby limit the maximum volume of inflation of the inflatable tube.

4. The buoyancy control device according to claim 1, wherein each of said inflatable members includes an inflatable tube of a material which is stretchable up to a maximum limit to thereby limit the maximum volume of inflation of the inflatable tube.

5. The buoyancy control device according to claim 1, wherein said source of compressed air is an air tank carried by the diver.

6. The buoyancy control device according to claim 1, wherein said fluid distributor includes a manual control knob enabling the diver to manually select the inflatable members to be inflated or deflated.

7. The buoyancy control device according to claim 6, wherein said fluid distributor further includes:

a housing having an inlet port connectible to said source of compressed air, a venting port leading to the atmosphere, and a plurality of outlet ports connected to said inflatable members, said housing including a surface formed with a groove communicating with all said ports;

a flexible membrane overlying said surface and having an inner face facing said groove, and an outer face facing away from said groove;

and a valve member movable by said manual control knob over the outer face of said membrane to press the membrane into the groove such as to effect communication between the inlet and venting ports with respect to selected outlet ports.

8. The buoyancy control device according to claim 7, wherein said ports are arranged in an array in which the first port at one end of the array is said inlet port, the last port at the opposite end of the array is said venting port, and the intermediate ports are outlet ports connected to said inflatable members.

9. The buoyancy control device according to claim 7, wherein said valve member is a roller which is rollable over the outer surface of said membrane.

10. The buoyancy control device according to claim 7, wherein said groove is of circular configuration and said valve member is movable in a circular path over said membrane.

11. The buoyancy control device according to claim 7, wherein said ports are formed radially through an edge in said housing and communicate with said groove via axial bores extending axially from said ports and terminating at one of their ends at said groove; said fluid distributor further including a main release valve normally closing the opposite ends of said axial bores but movable to open them all simultaneously and thereby to connect all the ports to the atmosphere.

12. The buoyancy control device according to claim 11, wherein said housing has a second surface formed with a second groove, said second groove communicating with said ports via the opposite ends of said axial bores, said main release valve being normally in contact with said second housing surface but being movable out of contact therewith to open said main release valve.

13. The buoyancy control device according to claim 12, wherein said second housing surface is formed in a conical cavity of the housing, said main release valve including a conical valve member normally seated in said conical cavity, but including a depressible actuator for unseating the conical valve member with respect to said cavity to open the main release valve.

* * * * *